US006893220B2

(12) United States Patent
Eaton et al.

(10) Patent No.: US 6,893,220 B2
(45) Date of Patent: May 17, 2005

(54) CENTRIFUGAL FAN

(75) Inventors: Erroll Lynn Eaton, Willimasville, NY (US); Steven C. Guzy, East Amherst, NY (US); Garrett Wade Hoehn, Kenmore, NY (US)

(73) Assignee: Delphi Technologies, Inc., Troy, MI (US)

( * ) Notice: Subject to any disclaimer, the term of this patent is extended or adjusted under 35 U.S.C. 154(b) by 63 days.

(21) Appl. No.: 10/342,961

(22) Filed: Jan. 15, 2003

(65) Prior Publication Data

US 2003/0235496 A1 Dec. 25, 2003

Related U.S. Application Data

(60) Provisional application No. 60/390,218, filed on Jun. 20, 2002.

(51) Int. Cl.[7] ..... F04D 29/54

(52) U.S. Cl. ..... 415/206; 416/185; 416/187; 416/189; 416/195; 416/228

(58) Field of Search ..... 415/206; 416/185, 416/186 R, 187, 188, 189, 223, 228, 190, 192, 195

(56) References Cited

U.S. PATENT DOCUMENTS

| | | | | | |
|---|---|---|---|---|---|
| 3,272,429 | A | * | 9/1966 | Wood | 416/186 R |
| 4,363,601 | A | * | 12/1982 | Leskinen | 416/188 |
| 4,647,271 | A | * | 3/1987 | Nagai et al. | 416/186 R |
| 5,927,947 | A | * | 7/1999 | Botros | 416/144 |
| 6,224,335 | B1 | | 5/2001 | Parisi et al. | 415/206 |

FOREIGN PATENT DOCUMENTS

JP 2001065495 A * 3/2001 ..... F04D/29/28

* cited by examiner

*Primary Examiner*—F. Daniel Lopez
*Assistant Examiner*—Dwayne White
(74) *Attorney, Agent, or Firm*—Patrick M. Griffin

(57) ABSTRACT

A centrifugal blower impeller includes a central hub and a plurality of impeller blades. The central hub includes a conical section and an outer edge. The conical section is centered with respect to a center axis and extends from the center axis towards the outer edge. The plurality of impeller blades includes first and second ends. The conical section is coupled to the first ends of the impeller blades which extend axially upward from the first ends towards the second ends. The centrifugal blower impeller also includes a rim which has a generally circular shape and is connected to the second ends of the impeller blades.

31 Claims, 7 Drawing Sheets

CENTRIFUGAL FAN

RELATED APPLICATION

This application claims priority to U.S. Provisional Patent Application 60/390,218 filed Jun. 20, 2002.

FIELD OF THE INVENTION

The present invention relates generally to centrifugal blowers, and more specifically, to a centrifugal blower having improved performance and lower noise.

BACKGROUND OF THE INVENTION

The most familiar air moving mechanism is the simple axial fan, which is the stationary equivalent of an airplane propeller. Whether used for residential cooling or automotive radiator cooling, it simply pulls air axially straight through it. Less familiar is the so called centrifugal blower, which finds common usage in vehicle HVAC systems. A centrifugal blower has a generally cylindrical impeller or fan rotating in one direction that pulls air in along its central axis as it rotates, but then forces it radially outwardly, turning it ninety degrees, in effect. A scroll shaped blower housing surrounding the impeller collects and confines the expelled air and sends it through a tangential outlet to the rest of the HVAC system.

The basic cylindrical impeller includes a central hub, often dome shaped, through which a motor drive shaft is attached, and a flat, annular outer rim. Extending upwardly from the hub rim are an evenly spaced series of identical blades, which are parallel to the central axis.

Plastic centrifugal fans for HVAC applications have traditionally had outer rims that are either external to the blade (external rims) or above part of the blade (split louver rims). Both external rims and split louver rims have high stress areas between the blades as the fan is spun to its operating speed, known as hoop stress. Hoop stress requires the use of higher strength materials, which generally have higher mass, and are more costly.

In attempting to minimize hoop stress, prior art designs have used external rim designs with a long axial length or a split louver design with a parabolic shaped rim of constant thickness. Both of these designs, add axial length and reduce noise, however, they do not add strength to the overall design and require strong, plastic materials with fillers that increase mass, cost, and variation in as-molded balance.

The present invention is aimed at one or more of the problems identified above.

SUMMARY OF THE INVENTION AND ADVANTAGES

In one aspect of the present invention, a centrifugal blower impeller is provided. The centrifugal blower impeller includes a central hub, a plurality of impeller blades, and a rim. The central hub includes a conical section and an outer edge. The central hub is centered with respect to a center axis and extends from the center axis towards the outer edge. The impeller blades have first and second ends. The conical section of the central hub intersects the first ends of the impeller blades. The impeller blades extend axially upward from the first ends towards the second ends. The rim has a generally circular shape and is connected to the second ends of the impeller blades.

In another aspect of the present invention, a centrifugal blower impeller is provided. The centrifugal blower impeller includes a central hub, a plurality of impeller blades, and a rim. The central hub includes a conical section and an outer edge. The central hub is centered with respect to a center axis and extends from the center axis towards the outer edge. The impeller blades have first and second ends. The conical section of the central hub is coupled to the first ends of the impeller blades. The impeller blades extend axially upward from the first ends towards the second ends. The rim has a generally circular shape and is connected to the second ends of the impeller blades. The rim has a first portion and a second portion. The first portion is generally parallel to the center axis and the second portion is generally perpendicular to the center axis. The first and second portions having a generally L-shaped cross-section.

BRIEF DESCRIPTION OF THE DRAWINGS

The patent or application contains at least one drawing executed in color. Copies of this patent or patent application publication with color drawing(s) will be provided by the Office upon request and payment of the necessary fee.

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
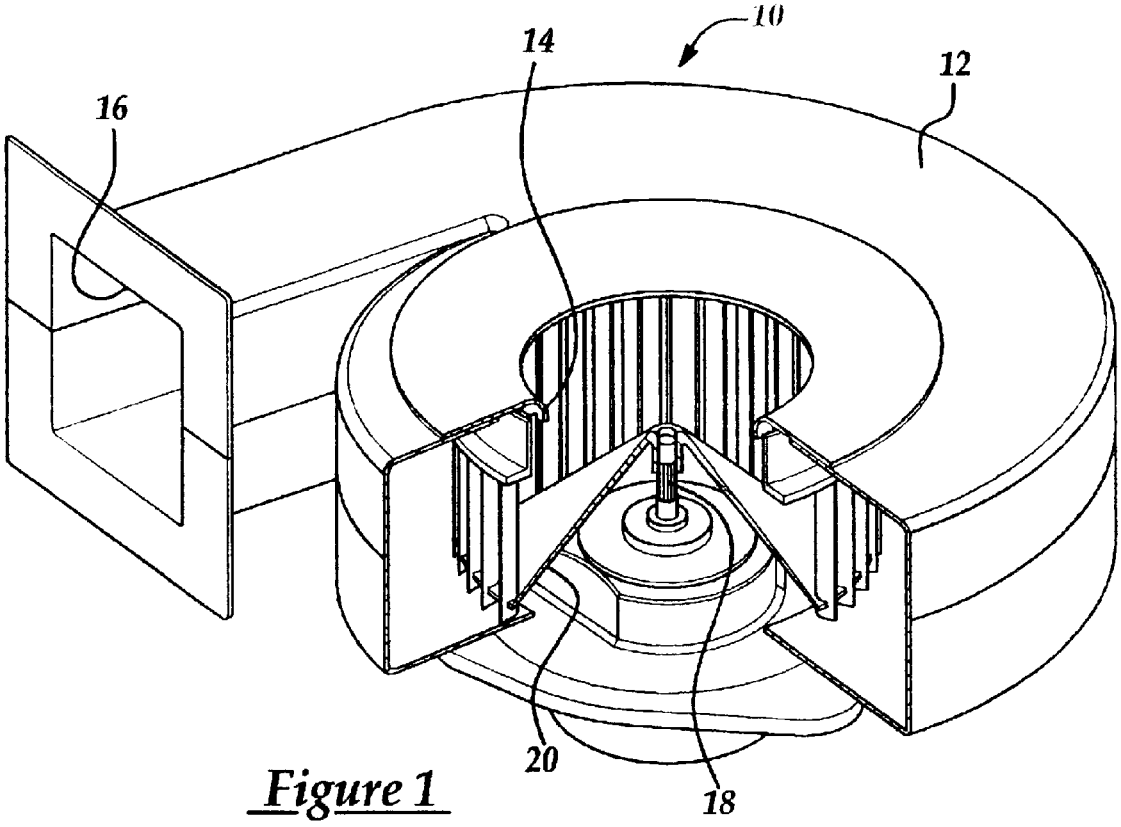
FIG. 1 is a perspective drawing of a centrifugal blower having a centrifugal blower impeller, according to an embodiment of the present invention.

With reference to FIG. 1, a centrifugal blower is indicated generally at 10. The blower 10 includes a scroll shaped housing 12, with a central, axial air inlet defined by a downturned cylindrical lip 14 and a tangential output 16. A central motor driven shaft 18 lies on the center axis of inlet lip 14, to which is secured a centrifugal blower impeller 20. The centrifugal blower impeller 20 is driven through rotation of the motor driven shaft 18. As the centrifugal blower impeller 20 spins, counterclockwise from the perspective of FIG. 1, outside air is drawn axially in through the inlet lip 14. Indrawn air is then pushed radially outwardly, swirling around counterclockwise between the centrifugal blower impeller 20 and the wall of housing 12 until it exits tangentially through outlet 16.

Figure 2A:
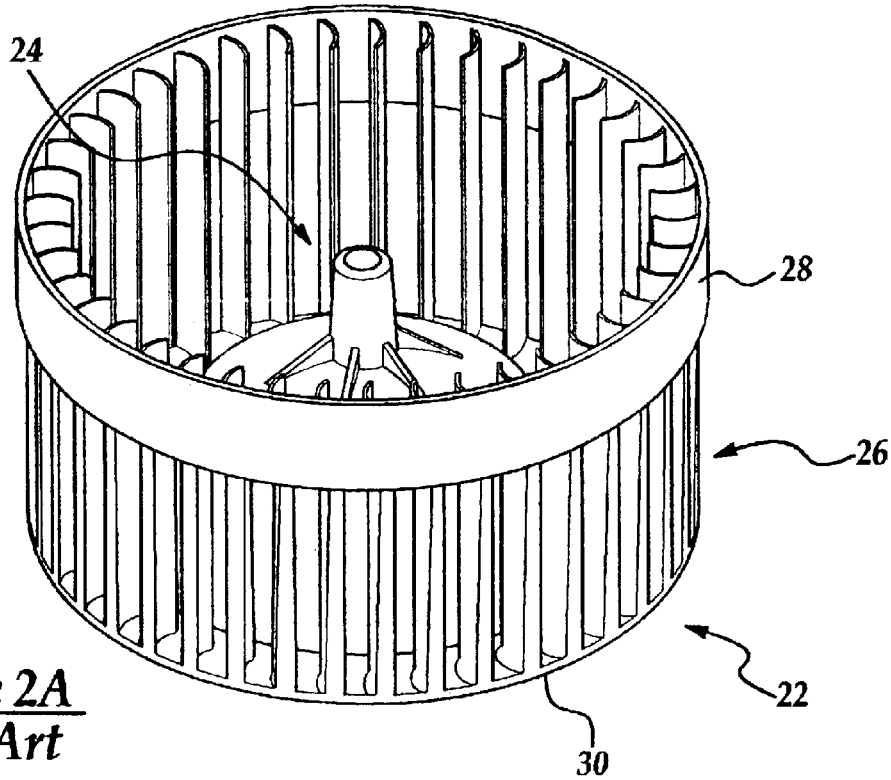
Figure 2A Prior Art
FIG. 2A is a first perspective drawing of a prior art impeller blade.
Figure 2B:
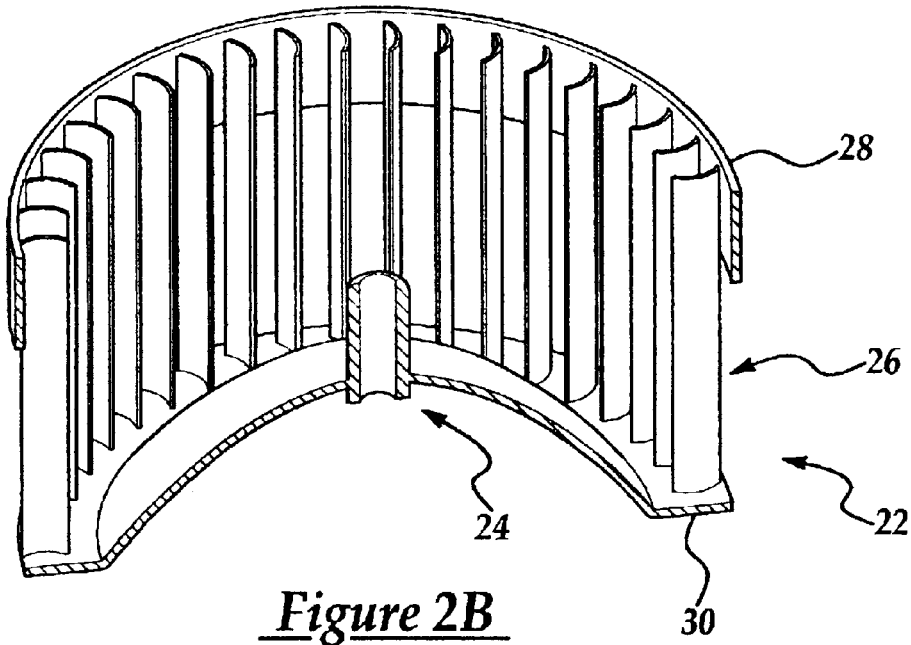
Figure 2B Prior Art
FIG. 2B is a second perspective drawing of the prior art impeller blade of FIG. 2A.

With reference to FIGS. 2A and 2B, a diagrammatic illustration of a prior art impeller blade assembly 22 is shown. The prior art impeller blade assembly 22 includes a hub 24, a plurality of blades 26, and a locking ring 28. An annular rim 30 is integral with the hub and extends generally perpendicular to a center axis of the impeller blade 22. One end of each of the blades 26 is connected to an upper surface of the annular rim 30. The blades 26 extend upward from the annular rim 30. The opposite ends of the blades are coupled to the locking ring 28.

Figure 2C:
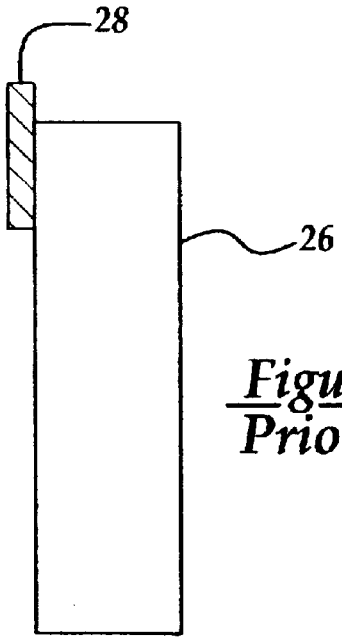
Figure 2C Prior Art
FIG. 2C is a diagrammatic illustration of a portion of the prior art impeller blade of FIG. 2A.
Figure 2D:
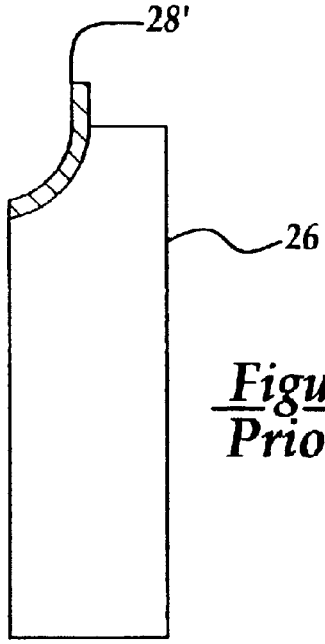
Figure 2D Prior Art
FIG. 2D is a diagrammatic illustration of a portion of another prior art impeller blade.

With reference to FIGS. 2C and 2D, diagrammatic illustrations of two prior art locking rings 28, 28' are shown. With specific reference to FIG. 2C, the locking ring 28 of FIGS. 2A and 2B is shown. The locking ring 28 is a circular band that encircles an outer edge of the blades 26. As shown, the cross section of the locking ring 28 is generally rectangular. A portion of the locking ring 28 may extend past the end of the blades 26. With specific reference to FIG. 2D, the locking ring 28' has a curved cross section and a portion of the locking ring 28' may extend past the end of the blades.

As discussed more fully below, the features of the centrifugal blower impeller 20 of the present invention improve the performance of the centrifugal blower 10, in terms of reduced noise level and increased efficiency. Further, the design of the centrifugal blower impeller 20 minimizes the stress points along the centrifugal blower impeller 20, allowing use of non-filled plastic materials with lower strength, thereby reducing cost, mass, and as-molded balance.

Figure 3:
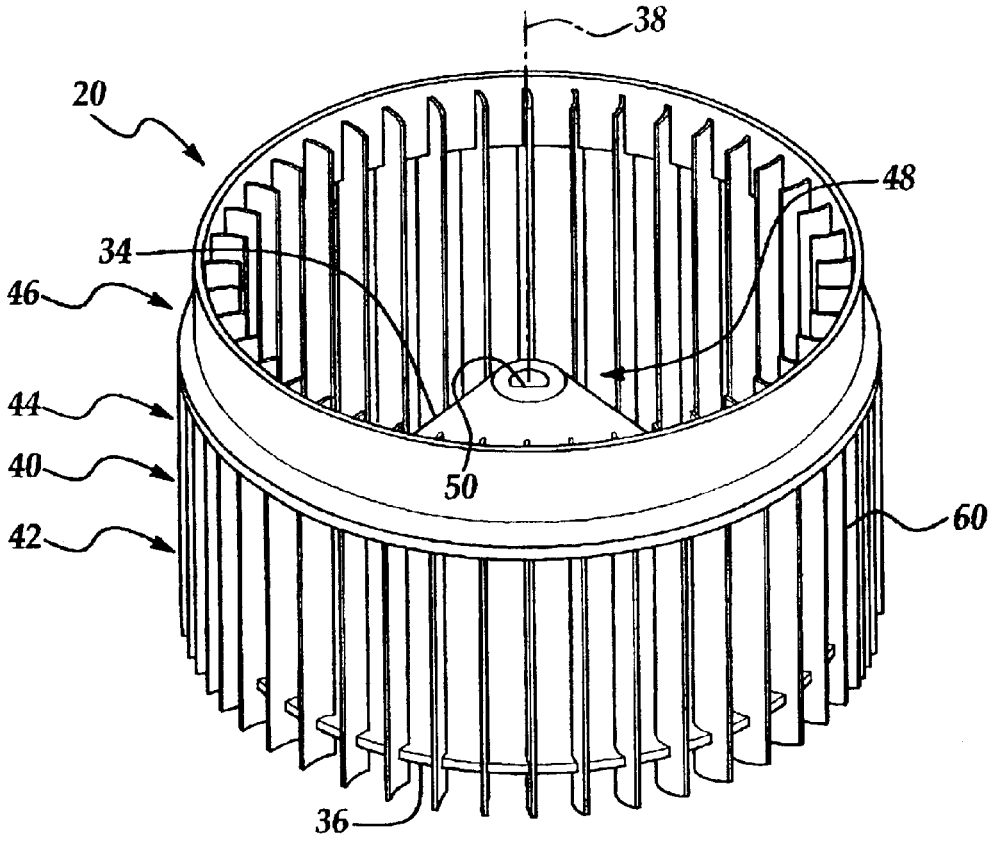
FIG. 3 is a first perspective drawing of the centrifugal blower impeller of FIG. 1.
Figure 4:
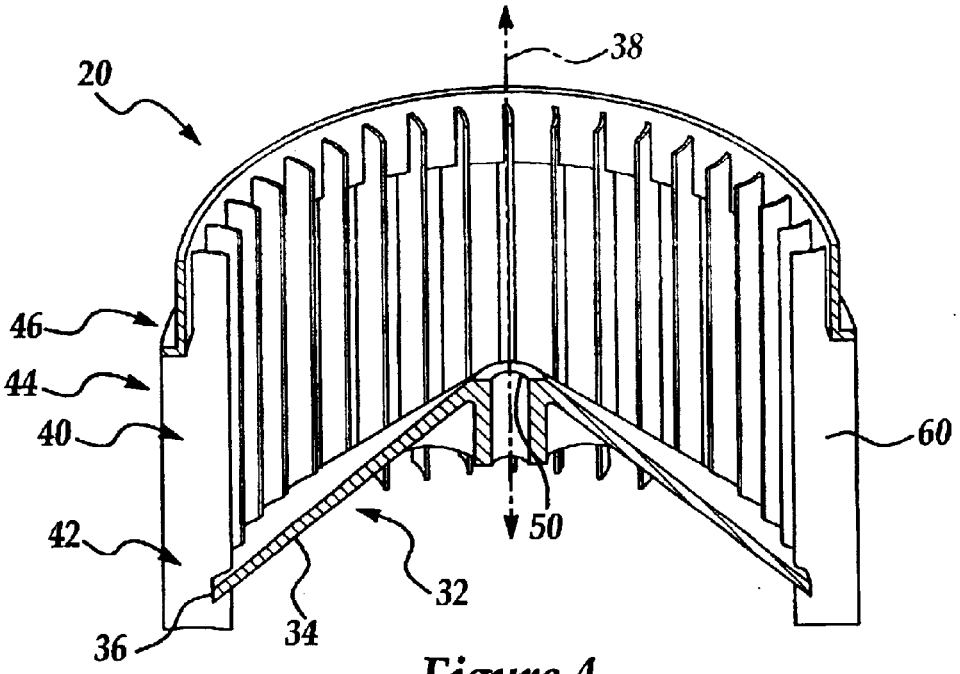
FIG. 4 is a second perspective drawing of the centrifugal blower of FIG. 1.

With reference to FIGS. 3 and 4, the centrifugal blower impeller 20 of the present invention includes a central hub 32. The central hub 32 includes a conical section 34 and an outer edge 36. The conical section 34 is centered along a center axis 38 and extends from the center axis 38 towards the outer edge 36. The centrifugal blower impeller 20 includes a plurality of impeller blades 40 having first and second ends 42, 44.

The conical section 34 of the central hub 32 is coupled to the first ends of the impeller blades 40. The impeller blades 40 extend axially upward (in the drawing) from the first ends 42 towards the second ends 44, as shown.

The centrifugal blower impeller 20 also includes a rim 46 which has a generally circular shape and is connected to the second ends 44 of the impeller blades 40.

In one aspect of the present invention, the central hub 32 intersects the first ends 42 of the impeller blades 40. In one embodiment, the central hub 32 intersects the plurality of impeller blades 40 at an angle with respect to the center axis.

In one embodiment, the central hub 32 includes a central portion 48 formed at an end of the central hub 32 opposite the outer edge 36. The central portion includes an interface aperture 50. In one embodiment, the interface aperture is 50 a D-shaft interface aperture. The central motor driven shaft 18 is likewise shaped to fit the D-shaft interface aperture 50. In another embodiment, the shaft 18 is a splined shaft. In still another embodiment, the shaft 18 is a smooth shaft.

In one embodiment, the central hub 32 is generally shaped as a right circular cone as shown. In another embodiment, the central hub 32 is concave. In still another embodiment, the central hub 32 is convex.

The impeller blades 40 have a blade length, identified as "C" on FIG. 5A (see below). The central hub 32 intersects the plurality of impeller blades 40 through a portion of the blade length C. In one embodiment, the portion of the blade length intersected by the central hub 32 is less than fifty percent of the total blade length. In another embodiment, the portion of the blade length intersected by the central hub 32 is greater then fifty percent of the total blade length. In still another embodiment, the portion of the blade length intersected by the central hub 32 is approximately one hundred percent of the total blade length.

In one embodiment, the centrifugal blower impeller is integrally molded from a plastic such as polypropylene. The blades 40 are radially wide enough, and flat enough, such that they would, without external support at the second ends 42, flex and bend excessively in operation. As best seen in FIGS. 3 and 4, each blade 40 is forwardly inclined and curved, i.e., slopes in the direction of rotation.

Figure 5A:
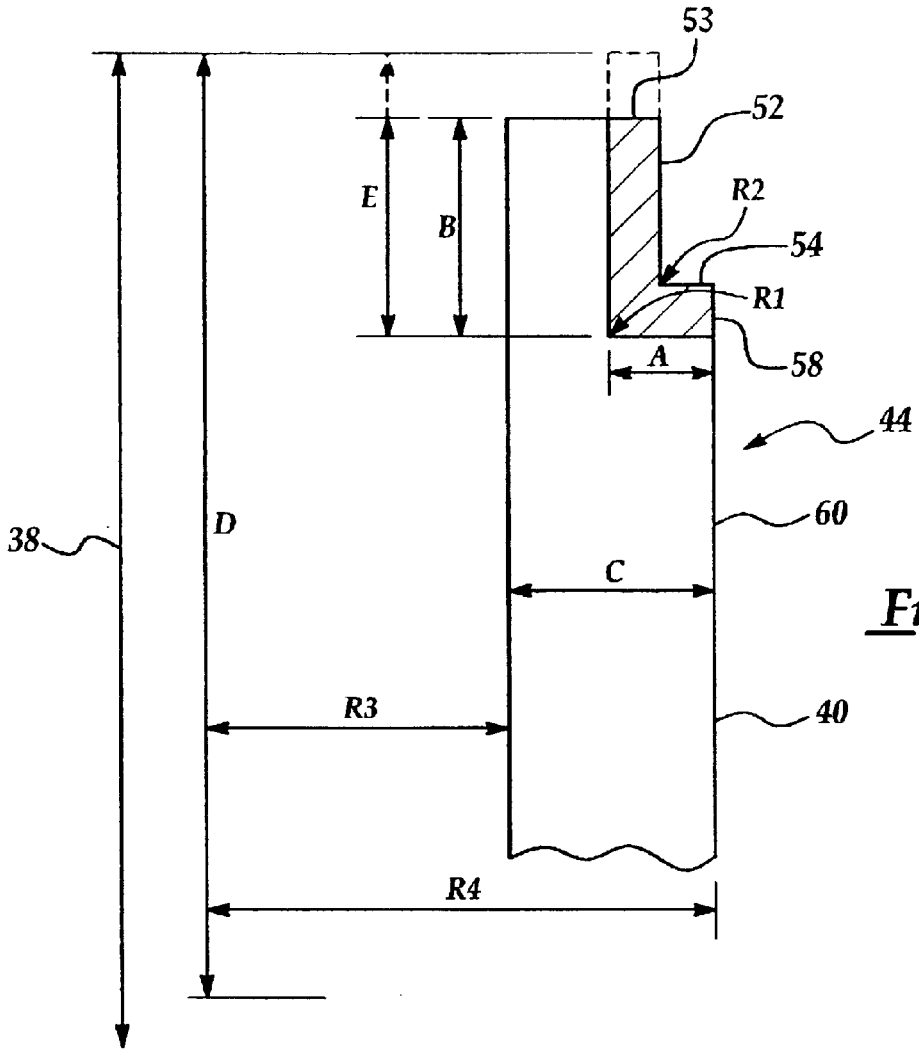
FIG. 5A is a diagrammatic illustration of a portion of the centrifugal blower of FIG. 1.

With particular reference to FIG. 5A, in another aspect of the present invention, the rim 46 includes a first portion 52 and a second portion 54.

In one embodiment, the first portion 52 is generally parallel to the center axis 38 and the second portion 54 is generally perpendicular to the center axis 38. As shown, the first and second portions 52, 54 having a generally L-shaped cross-section.

The first portion 52 of the rim 46 has a first edge 56. In one embodiment, the first edge 56 is in a common plane with edges of the second ends 44 of the impeller blades 40 (as shown in FIG. 5A). In another embodiment, the first edge 56 of the rim 46 extends past the second ends 44 of the blades 40 (as shown in dotted lines). In another embodiment, the second ends 44 of the blades 40 extend past the first edge 56 of the rim 46.

The second portion 54 of the rim 46 has a rim outer edge 58. Each impeller blade 40 has a blade outer edge 60. In one embodiment, the rim outer edge 58 and the blade outer edges 60 are generally equidistance from the center axis 38 as shown. In another embodiment, the rim outer edge 58 may extend beyond the blade outer edges 60. In still another embodiment, the blade outer edges 60 extend beyond the rim outer edge 58.

Figure 5B:
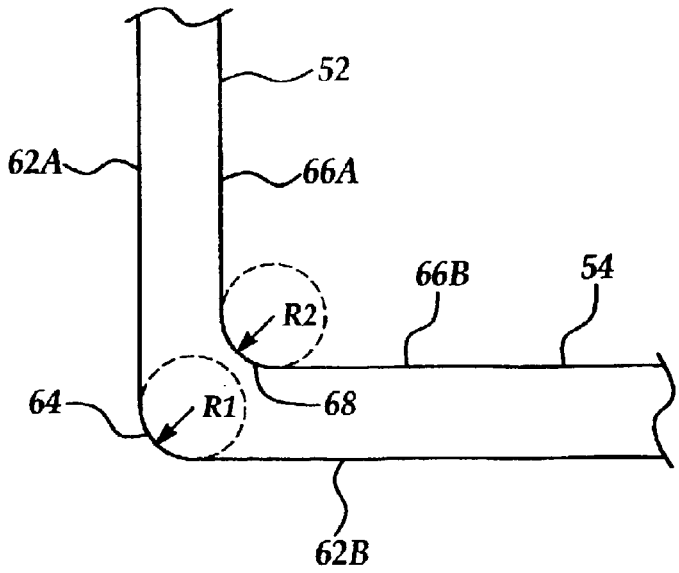
FIG. 5B is a second diagrammatic illustration of the portion of the centrifugal blower of FIG. 1.

With reference to FIGS. 5A and 5B, the following dimensions are defined:

R1: inside radius of rim 46,

R2: outside radius of rim 46,

R3: inside radius of fan blades 40 relative to the center axis 38,

R4: outside radius of fan blades 40 relative to the center axis 38,

A: radial length of the rim 46,

B: axial length of the rim 46 into blade 40,

C: length of blades 40 (R4–R3),

D: height of blades 40, and,

E: total axial length of rim 46.

Although the first and second portions 52, 54 are generally perpendicular, due to manufacturing limitations, the edges of the rim 46 may not meet at right angles. As shown in the illustration of FIG. 5B, inner edges 62A, 62B are joined by an arc 64. The arc 64 has a radius (defined by the dashed circle) of R1. Likewise outer edges 66A, 66B are joined by an arc 68. The arc 68 has a radius (defined by the dashed circle) of R2.

In one aspect of the present invention, the inside radius (R1) of the rim 46 is minimized, i.e., less than a predetermined value. Minimizing the inside radius, R1, of the rim 46 reduces stress levels within the centrifugal blower impeller 20 and particularly, the rim 46. Lower rim stress allows the use of lower strength, non-filled materials, such as polypropylenes which result in more consistent balance levels, lower mass and thus lower cost. In addition, the stronger centrifugal blower impeller allows for better dimensional stability.

Figure 9A:
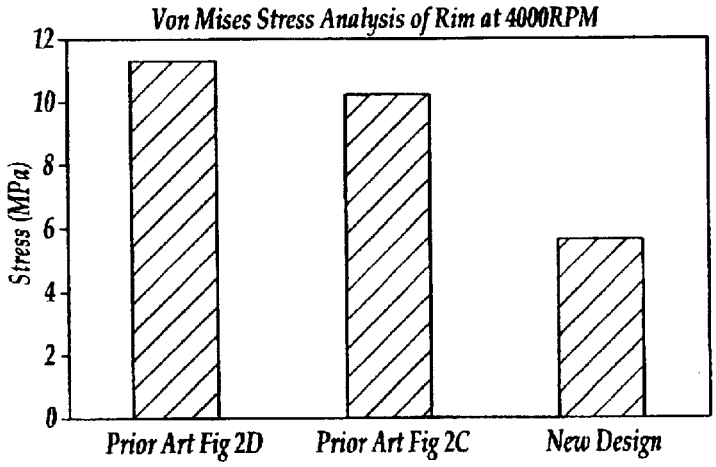
FIG. 9A is a graph comparing the maximum Von Mises stress of two prior art rim designs and the rim of the present invention; and, FIG. 9B is a graph comparing the specific sound power level stress of two prior art rim designs and the rim of the present invention.

With reference to FIG. 9A, finite element analysis (FEA) shows the relative maximum Von Mises stress of prior art rims 28, 28' (as shown in FIGS. 2C and 2D, respectively) and the current design rim 46, all made of the same material at a constant speed with the same air loading. As shown, the maximum Von Mises stress of the first prior art rim design 28 was 11.28 mega Pascal and the maximum Von Mises stress of the second prior art rim design 28' was 6.2 mega Pascal. In contrast, the maximum Von Mises stress of the current rim design 46 was 5.96 mega Pascal.

Figure 9B:
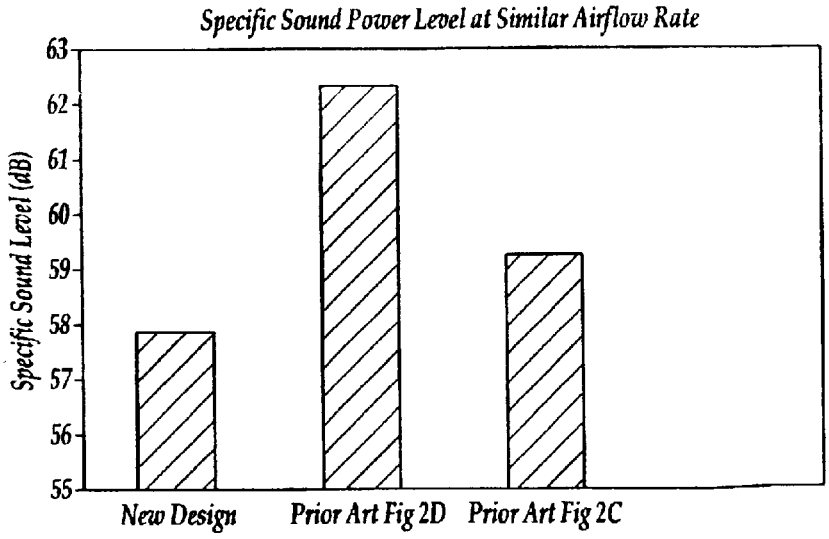

With reference to FIG. 9B, the specific sound power level of the two prior art rims 28, 28' and the rim 46 of the present invention are shown, at the same speed (RPM), and same air restriction. As shown, the current design has a much lower specific sound power level than the two prior art designs.

In a first embodiment, $0 \leqq R1 \leqq 0.5$ millimeters.

In a second embodiment, $0 \leqq R1 \leqq 1.0$ millimeters.

In a third embodiment, $0 \leqq R1 \leqq 2.0$ millimeters.

In a fourth embodiment, $0 \leqq R1 \leqq 4.0$ millimeters.

In a fifth embodiment, $0 \leqq R1 \leqq 8.0$ millimeters.

In another aspect of the present invention, the outer radius of the rim 46 is minimized, i.e., less than a predetermined value. Minimizing the outer radius, R2, of the rim 46 reduces stress levels within the centrifugal blower impeller 20.

In a first embodiment, $0 \leqq R2 \leqq 0.5$ millimeters.

In a second embodiment, $0 \leqq R2 \leqq 1.0$ millimeters.

In a third embodiment, $0 \leqq R2 \leqq 2.0$ millimeters.

In a fourth embodiment, $0 \leqq R2 \leqq 4.0$ millimeters.

In a fifth embodiment, $0 \leqq R2 \leqq 8.0$ millimeters.

In a sixth embodiment, R2 is equal to 0.25 millimeters.

The rim 46 is designed to allow for maximum attachment to the blades 40 in both the vertical direction (along the first portion 52) and the horizontal direction (along the second portion 54). The second portion 54 of the rim 46 provides the strength in the centrifugal blower impeller 20 to reduce stress at the blade attachment to the rim 46. By maximizing the blade 40 to rim 46 attachment area, the stress levels and deflection of the blades 40 are minimized. The second portion 54 also reduces the cantilever stress. For example, maximum stress with the centrifugal blower impeller 20 may be reduced up to fifty percent over prior art impeller designs of the type represented by FIGS. 2A–2D.

In one aspect of the present invention, the ratio of the radial length, A, of the rim 46 to the radial length, C, of the blades 40 is minimized to allow for maximum attachment between the rim 46 and the blade 40.

In a first embodiment, $0.1 \leqq (A/C) \leqq 1.0$.

In a second embodiment, $0.2 \leqq (A/C) \leqq 1.0$.

In a third embodiment, $0.3 \leqq (A/C) \leqq 1.0$.

In a fourth embodiment, $0.4 \leqq (A/C) \leqq 1.0$.

In a fifth embodiment, $0.5 \leqq (A/C) \leqq 1.0$.

In a sixth embodiment, A/C=0.4.

In a seventh embodiment, A/C=0.5.

In another aspect of the present invention, the ratio of the axial length of the rim into the blade, B, to the blade height, D, is between predetermined values.

In a first embodiment, $0.05 \leqq (B/D) \leqq 0.4$.

In a second embodiment, $0.1 \leqq (B/D) \leqq 0.4$.

In a third embodiment, B/D=0.23.

Figure 6:
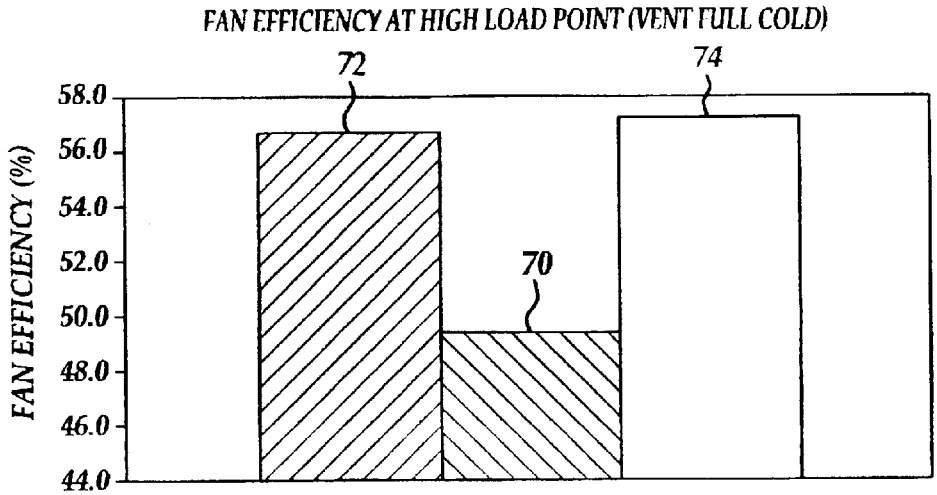
FIG. 6 is a graph of test results illustrating the improved performance of a centrifugal blower, according to an embodiment of the present invention.

With reference to FIG. 6, the centrifugal blower impeller 20 of the present invention has been tested and proven to increase the efficiency of the centrifugal blower 10. As shown, the efficiency of a centrifugal blower with a blade assembly having the locking ring 28 (of FIG. 2C) is shown at 70, the efficiency of a centrifugal blower with a blade assembly having the locking ring 28' (of FIG. 2D) is shown at 72, and the efficiency of the centrifugal blower 10 with the centrifugal blower impeller 20 of the present invention is shown at 74.

Figure 7:
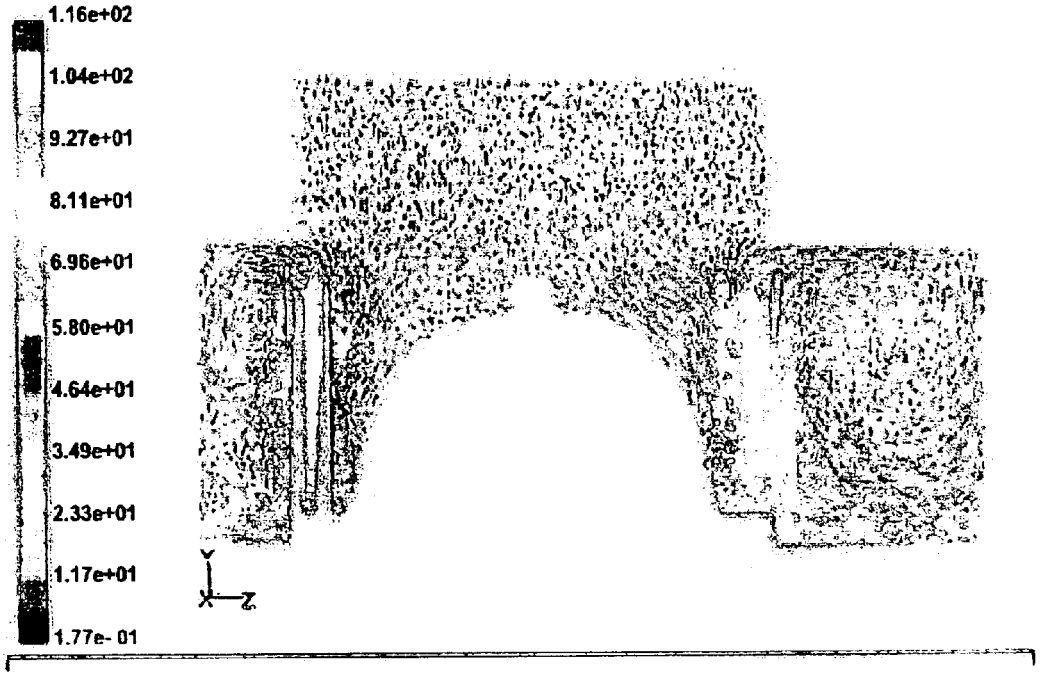
FIG. 7 is a graph illustrating air flow through a prior art centrifugal blower.

Furthermore, the conical shape of the central hub 32 beneficially affects the airflow through the centrifugal blower 10. Efficiency can be gained by a more uniform airflow through the blades 40. The airflow through a prior art impeller blade is shown in FIG. 7. First, the light blue coloring on the left and right sides of the graph (corresponding to the blades) show a concentration of airflow through a middle portion of the blades. Also on the left side of the graph, airflow is reduced significantly near the bottom of the blades.

Figure 8:
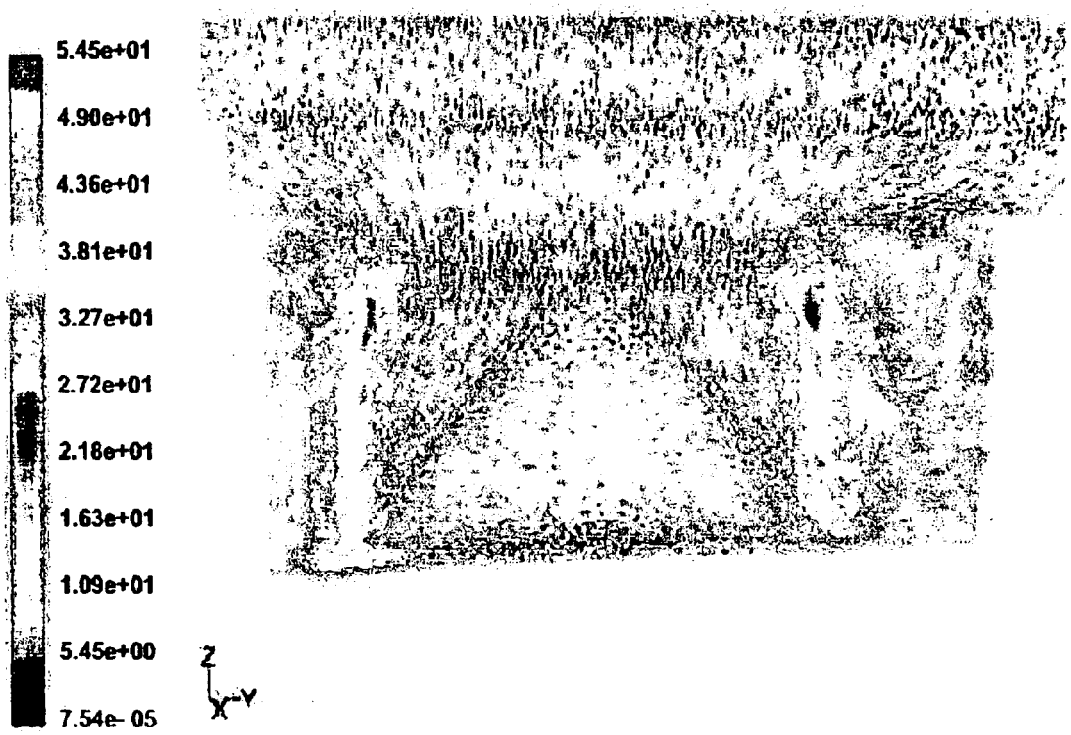
FIG. 8 is a graph illustrating air flow through a centrifugal blower having a centrifugal blower impeller, according to an embodiment of the present invention.

In contrast, the graph of FIG. 8, illustrates a more uniform flow of air through the centrifugal blower impeller 20 of the present invention which results in a higher efficiency.

Obviously, many modifications and variations of the present invention are possible in light of the above teachings. The invention may be practiced otherwise than as specifically described within the scope of the appended claims.

What is claimed is:

1. A centrifugal blower impeller, comprising:

a central hub having a conical section and an outer edge, the conical section being centered with respect to a center axis and extending from the center axis towards the outer edge;

a plurality of impeller blades having first and second ends, the conical section of the central hub intersecting the first ends of the impeller blades, the impeller blades extending axially upward from the first ends towards the second ends; and;

a rim having a generally circular shape and being connected to the second ends of the impeller blades, the rim including a first portion and a second portion, wherein the first portion is generally parallel to the center axis, and the second portion is generally perpendicular to the center axis, the first and second portions having a generally L-shaped cross-section, the first portion of the rim has a first edge, the second ends of the blades extending past the first edge.

2. A centrifugal blower impeller, as set forth in claim 1, wherein the central hub includes a central portion formed at an end of the central hub opposite the outer edge, the central portion having an interface aperture.

3. A centrifugal blower impeller, as set forth in claim 2, wherein the interface aperture is a D-shaft interface aperture.

4. A centrifugal blower impeller, as set forth in claim 1, wherein the central hub is generally shaped as a right circular cone.

5. A centrifugal blower impeller, as set forth in claim 1, wherein the conical section is one of concave and convex.

6. A centrifugal blower impeller, as set forth in claim 1, wherein the central hub intersects the plurality of impeller blades at an angle with respect to the center axis.

7. A centrifugal blower impeller, as set forth in claim 1, wherein the impeller blades have a blade length and the central hub intersects the plurality of impeller blades through a portion of the blade length.

8. A centrifugal blower impeller, as set forth in claim 1, wherein the impeller blades are curved.

9. A centrifugal blower impeller, as set forth in claim 1, wherein the first portion of the rim has a first edge, the first edge being in a common plane with edges of the second ends of the impeller blades.

10. A centrifugal blower impeller, as set forth in claim 1, wherein the rim has an inner radius (R1), where $0 \leqq R1 \leqq 0.5$ millimeters.

11. A centrifugal blower impeller, as set forth in claim 1, wherein the rim has an inner radius (R1), where $0 \leqq R1 \leqq 1.0$ millimeters.

12. A centrifugal blower impeller, as set forth in claim 1, wherein the rim has an inner radius (R1), where $0 \leqq R1 \leqq 2.0$ millimeters.

13. A centrifugal blower impeller, as set forth in claim 1, wherein the rim has an inner radius (R1), where $0 \leqq R1 \leqq 4.0$ millimeters.

14. A centrifugal blower impeller, as set forth in claim 1, wherein the rim has an inner radius (R1), where $0 \leqq R1 \leqq 8.0$ millimeters.

15. A centrifugal blower impeller, as set forth in claim 1, wherein the rim has an outer radius (R2), where $0 \leqq R2 \leqq 0.5$ millimeters.

16. A centrifugal blower impeller, as set forth in claim 1, wherein the rim has an outer radius (R2), where $0 \leqq R2 \leqq 1.0$ millimeters.

17. A centrifugal blower impeller, as set forth in claim 1, wherein the rim has an outer radius (R2), where $R2 \leqq 2.0$ millimeters.

18. A centrifugal blower impeller, as set forth in claim 1, wherein the rim has an outer radius (R2), where $0 \leqq R2 \leqq 4.0$ millimeters.

19. A centrifugal blower impeller, as set forth in claim 1, wherein the rim has an outer radius (R2), where $0 \leqq R2 \leqq 8.0$ millimeters.

20. A centrifugal blower impeller, as set forth in claim 1, wherein the rim has an outer radius (R2), where $R2 \leqq 0.25$ millimeters.

21. A centrifugal blower impeller, as set forth in claim 1, wherein the rim has a radial length (A) and the blades have a blade length (C), where $0.1 \leqq (A/C) \leqq 1.0$.

22. A centrifugal blower impeller, as set forth in claim 1, wherein the rim has a radial length (A) and the blades have a blade length (C), where $0.2 \leqq (A/C) \leqq 1.0$.

23. A centrifugal blower impeller, as set forth in claim 1, wherein the rim has a radial length (A) and the blades have a blade length (C), where $0.3 \leqq (A/C) \leqq 1.0$.

24. A centrifugal blower impeller, as set forth in claim 1, wherein the rim has a radial length (A) and the blades have a blade length (C), where $0.4 \leqq (A/C) \leqq 1.0$.

25. A centrifugal blower impeller, as set forth in claim 1, wherein the rim has a radial length (A) and the blades have a blade length (C), where $0.5 \leqq (A/C) \leqq 1.0$.

26. A centrifugal blower impeller, as set forth in claim 1, wherein the rim has a radial length (A) and the blades have a blade length (C), where $A/C=0.4$.

27. A centrifugal blower impeller, as set forth in claim 1, wherein the rim has a radial length (A) and the blades have a blade length (C), where $A/C=0.5$.

28. A centrifugal blower impeller, as set forth in claim 1, wherein the rim has an axial length into the blade (B) and the blades have a blade height (D), where $0.05 \leqq (B/D) \leqq 0.4$.

29. A centrifugal blower impeller, as set forth in claim 1, wherein the rim has an axial length into the blade (B) and the blades have a blade height (D), where $0.1 \leqq (B/D) \leqq 0.4$.

30. A centrifugal blower impeller, as set forth in claim 1, wherein the rim has an axial length into the blade (B) and the blades have a blade height (D), where $B/D=0.23$.

31. A centrifugal blower impeller, comprising:

a central hub having a conical section and an outer edge, the conical section being centered with respect to a center axis and extending from the center axis towards the outer edge;

a plurality of impeller blades having first and second ends, the conical section of the central hub intersecting the first ends of the impeller blades, the impeller blades extending axially upward from the first ends towards the second ends; and;

a rim having a generally circular shape and being connected to the second ends of the impeller blades, the rim including a first portion and a second portion, wherein the first portion is generally parallel to the center axis, and the second portion is generally perpendicular to the center axis, the first and second portions having a generally L-shaped cross-section, wherein the second portion of the rim has a rim outer edge and each impeller blade has a blade outer edge, the blade outer edges extending past the rim outer edge.

* * * * *